US005263639A

United States Patent [19]

Lee et al.

[11] Patent Number: 5,263,639

[45] Date of Patent: Nov. 23, 1993

[54] ROBOTIC COIL WINDING SYSTEM

[75] Inventors: Donald S. Lee; Paul W. Stein; Ricky L. Wallace, all of Baltimore; Jeffrey M. Zerr, Pikesville, all of Md.

[73] Assignee: Necoa, Incorporated, Baltimore, Md.

[21] Appl. No.: 832,945

[22] Filed: Feb. 10, 1992

[51] Int. Cl.[5] ..... H01F 5/04

[52] U.S. Cl. ..... 228/176; 29/605

[58] Field of Search ..... 228/176, 179; 29/605

[56] References Cited

U.S. PATENT DOCUMENTS 3,667,118 6/1972 Camardella ..... 29/605

*Primary Examiner*—Kenneth J. Ramsey

*Attorney, Agent, or Firm*—Leonard Bloom

[57] ABSTRACT

A robotic coil winding system for automatically winding electrical coils, the system employing a robotic arm for transferring a workpiece between a plurality of separate work stations, thereby eliminating the need for individualized transfer mechanisms associated with each of the work stations, and a central controller for coordinating the operations of the robotic arm and the plurality of separate work stations.

6 Claims, 14 Drawing Sheets

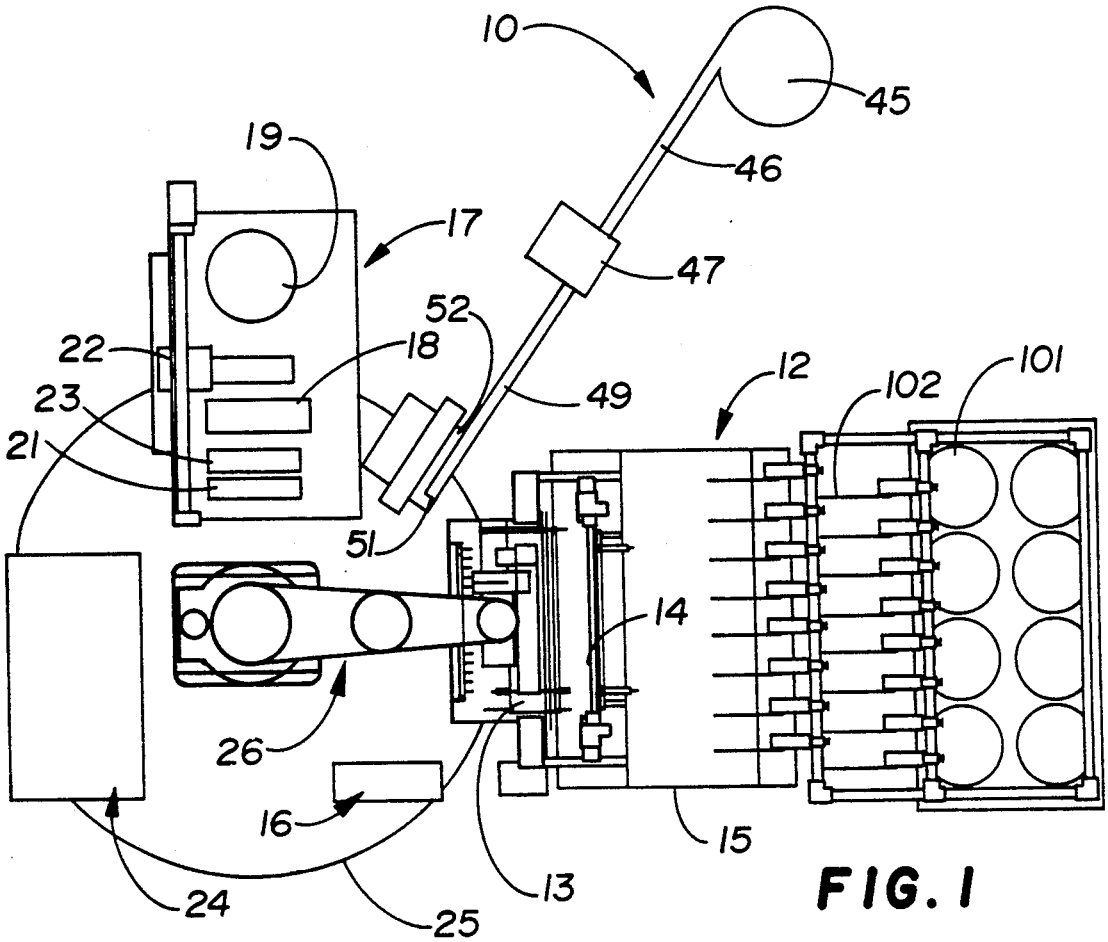
FIG. 1
FIG. 2
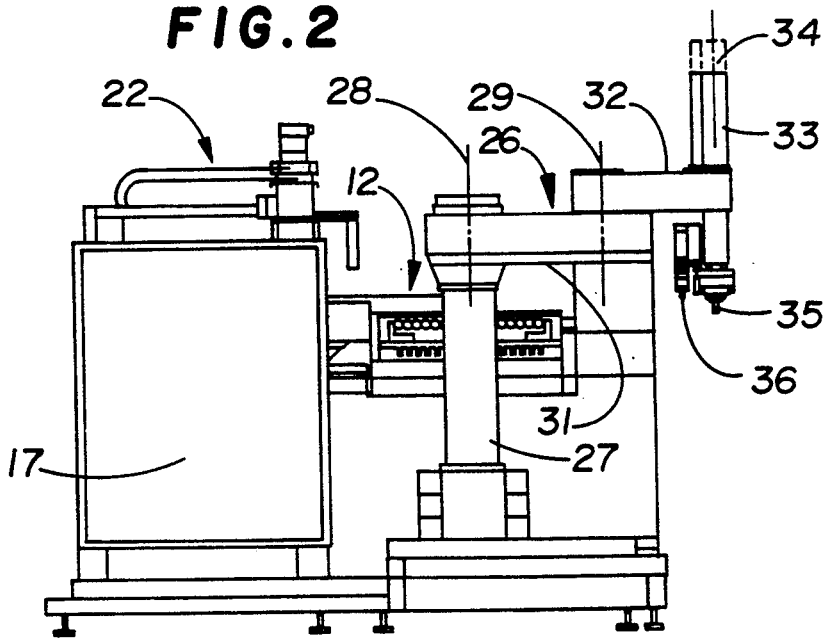

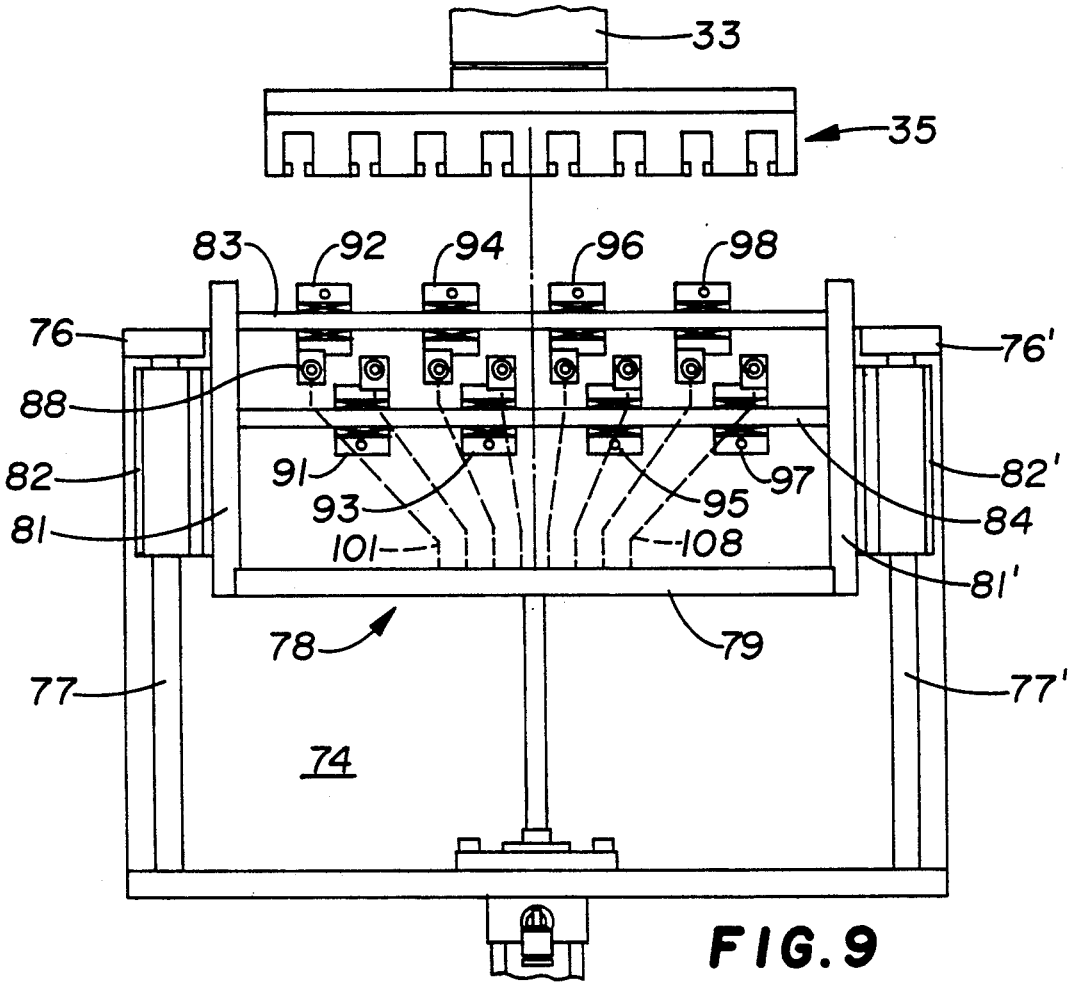
FIG. 9
FIG. 8
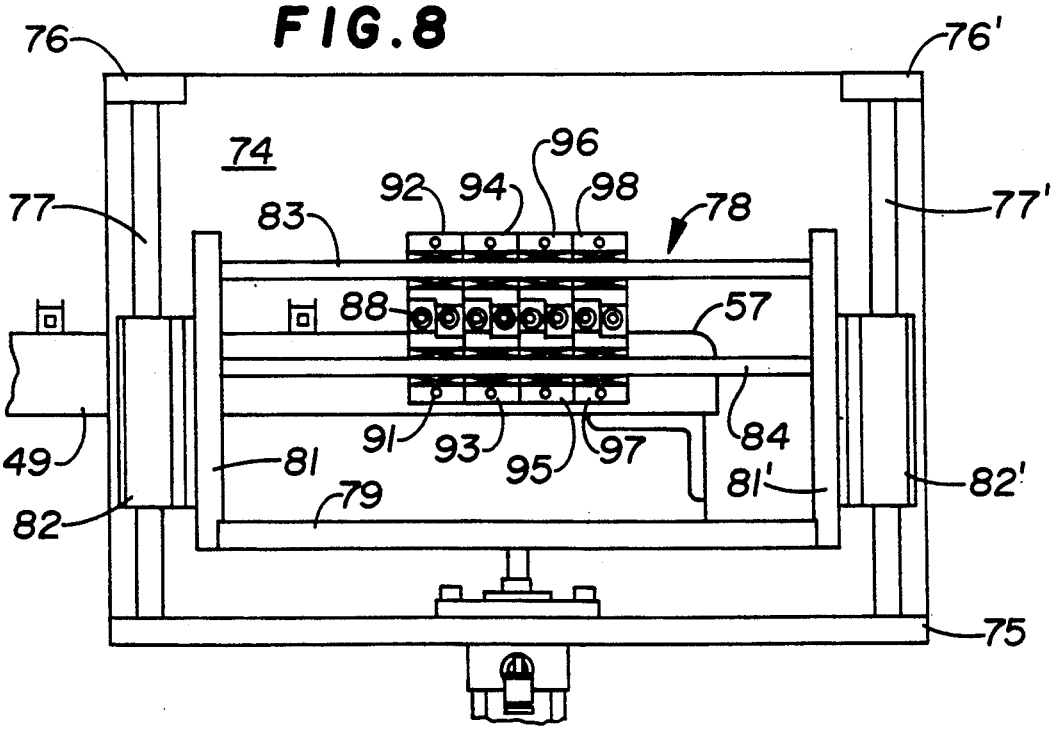

ROBOTIC COIL WINDING SYSTEM

The present invention relates to a method and means for winding electrical coils. More particularly, it relates to an automated process for manufacturing electrical coils in which operations are carried out at separate work stations and the work in process is transferred between each work station by a robotic arm under the command of a central control, which also exercises supervisory control over all operations of the separate work stations.

BACKGROUND OF THE INVENTION

One prior automated coil winding system employs separate work stations, similar to the work stations of the present invention, for performing the different steps of the manufacturing process. These steps are typically: unloading blank coil bobbins from a bulk supply; inserting terminals in the blank bobbins; winding coils on the bobbins; fluxing and soldering the coil ends to the bobbin terminals and electrically testing the coils; and unloading the finished coils. The work stations are arranged in a line and work is moved from station to station by a conveyer belt that travels the length of the line. Each station is equipped with its own transfer mechanism for removing arriving work from the conveyer belt, installing the work at the station for processing, and returning processed work to the conveyer belt for transport to the following work station. Each work station operates under the command of its own controller, with the controller of one station serving as a master for synchronizing operations of the subordinate controllers.

Certain disadvantages are associated with the prior automated coil winding system described above. The individualized transfer mechanisms associated with each of the work stations require a multiplicity of actuators, sensors and the like. The specialized tooling needed for the various transfer mechanisms increases the costs and time involved in setting up the system for initial production and complicates changing from production of coils of one particular design to coils of a different design. The individualized controllers of each of the work stations increase the capital costs of the equipment, make programming more difficult and time consuming, and increase the time and costs of maintaining and repairing the equipment.

It is an object of the present invention to provide a method and means for automatically winding electrical coils in which individualized transfer mechanisms associated with separate work stations are eliminated.

It is another object of the invention to provide a method and means for automatically winding electrical coils in which operations at separate work stations are carried out under the command of a central controller.

It is a further object of the invention to provide a method and means for automatically winding electrical coils in which the process is carried out at separate work stations and the work in process is transferred between the separate work stations by a robotic arm.

Still other objects of the invention are to provide an automated system for winding electrical coils which facilitates processing of a variety of coil bobbin specifications, thereby reducing the costs of specialized tooling and system set-up, simplifying maintenance and repair operations, and reducing the number and variety of spare parts required.

Other objects and advantages of the invention will become evident as a complete understanding thereof is gained from the following complete description and the accompanying drawings.

SUMMARY OF THE INVENTION

Briefly, the robotic coil winding system of the invention comprises a plurality of separate work stations for performing the steps of: (a) unloading blank coil bobbins from a bulk supply; (b) inserting terminals in the bobbins; (c) winding coils on the bobbins; (d) strain relieving the wire terminations on the wound bobbins; (e) fluxing and soldering the coil ends to the bobbin terminals; (f) electrically testing the coils; and (g) unloading the finished coils from the system. The work stations are circularly arranged about the periphery of the work envelope of a robotic arm that moves the bobbin from work station to work station as the work progresses. The robotic arm is mounted at one end for rotation abut a first, fixed, vertical axis in a horizontal plane at a level above the load/unload levels of the separate work stations. The arm is articulated medially along its length for rotation about a second vertical axis. A manipulator is mounted at the outer end of the arm for handling the bobbins to be moved by the arm. The manipulator is mounted for rotation about a third vertical axis and for vertical reciprocation along the third axis. By a combination of motions about the three vertical axes, the manipulator may be moved rectilinearly to any position within a work envelope defined by the generally circular path circumscribed by the arm at its maximum extension. The lower end of the manipulator is fitted with a gripper capable of grasping and holding a plurality of bobbins simultaneously. All movements of the arm and all operations at the work stations are directed by a single central controller.

At the beginning of a cycle, the arm moves to the first station where the bobbins are unloaded from bulk, terminals are inserted in the bobbins and the bobbins are presented in a spaced and oriented array. The manipulator grasps a batch of bobbins and moves to the second station, the winding machine, where the bobbins are placed on an indexer-loader for transfer into the winding machine. Typically, the gripper of the manipulator can handle eight bobbins simultaneously while the coil winder is capable of winding sixteen coils simultaneously. Therefore, the arm will move two batches of bobbins from the first station to the second station before coil winding begins.

When the indexer-loader has been loaded with a compliment of blank bobbins, the indexer-loader transfers the blanks to the winding machine. After winding, the wound coils are returned by the winding machine to the indexer-loader for removal by the robot arm. The manipulator grasps a batch of wound coils from the indexer-loader and the arm moves the batch to the strain relief station where the terminals of the bobbins are pressed more deeply into the bobbin forms to provide a small amount of slack at the coil ends. The coils are held by the manipulator during the strain relief operation. The arm then carries the batch of coils to the flux and solder station where the manipulator is maneuvered so as to dip the coil terminals in a flux bath and then in a solder bath. Then the arm moves the coil batch to an electrical test station for test of the coil continuity and, finally, the arm deposits the good coils of the batch in an unload area for removal from the system and deposits the bad coils of the batch in a segregated section of the unload area for removal from the system.

In an alternative arrangement, the flux, solder, and test steps are performed at the same station. The arm deposits a batch of coils taken from the winding machine in a receiving fixture at that station and then proceeds to other duties, such as loading another batch of bobbins onto the indexer-loader. The station is equipped with a "pick and place" mechanism which retrieves the coil batch from the receiving fixture, moves the batch for treatment in the flux bath and the solder bath and then deposits the soldered batch into an output fixture in which the electrical test is conducted. The arm returns to the station to remove the coil batch from the output fixture and carry the batch to the unload area and there separate the good coils from the bad coils. The alternative arrangement is adopted where coil production rates are such that the arm needs to be free to perform other duties while the flux, solder and test operations are taking place.

The invention provides an automated coil winding system in which the conveyer belt and pallets for holding work on the conveyer belt are eliminated. Transfer mechanisms for moving work between the conveyer belt and the work stations are largely eliminated, except for the indexer-loader of the winding machine, and for the pick and place mechanism of the alternative arrangement. The invention simplifies programming the control of the system by placing substantially all operations under the command of a central controller and reduces the cost of the system by eliminating duplicate controllers.

DESCRIPTION OF THE DRAWINGS

FIG. 1 is a plan view of the robotic coil winding system of the invention.

FIG. 2 is a front elevation of the invention.

FIG. 8 is a front elevation of the bobbin spacer of FIG. 6 with the rack thereof in the lowered position.

FIG. 9 is a front elevation of the bobbin spacer of FIG. 6 with the rack thereof in the raised position.

DETAILED DESCRIPTION OF THE INVENTION

Figure 3A:
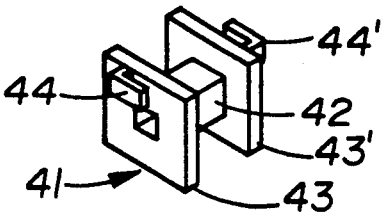
FIG. 3A is an isometric view of a typical form of blank bobbin.

FIGS. 1 and 2 broadly illustrate the robotic coil winding system of the invention. Referring to FIG. 1, the system comprises a work station 10 at which bobbins are unloaded from a bulk supply, terminals are inserted in the bobbins and the bobbins properly oriented and spaced into a batch for movement to a work station 12, at which coils are wound on the bobbins. At work station 12, the batch of coils is placed on an indexer-loader 13 that installs the bobbins on the spindles 14 of a winding machine 15. After coils are wound on a batch of bobbins, the batch is returned to the indexer-loader 13 and from there the batch is moved to a work station 16 where the terminals are pressed more deeply into the bobbins to relieve stress at the coil ends. It will be understood to those skilled in the art that means must be provided for relieving stress at the coil ends, and that other well-known devices exist for accomplishing this. Next, the batch of bobbins is moved to and deposited at a work station 17 at which the terminals of the bobbin batch are treated in a flux bath 18, a solder bath 9, and the soldered coils are electrically tested. The batch of coils is deposited in a receiving fixture 21 at station 17 and from there is moved to the flux bath 18 and to the solder bath 19 by a "pick and place" mechanism 22 that returns the batch of soldered coils to a test fixture 23. Finally, the good coils of the batch are moved from the test fixture 23 to an unload area 24 for removal from the system and the bad coils of the batch are removed from the test fixture 23 to a segregated portion of the unload area 24 for removal from the system.

The work stations 10, 12, 6, 17 and unload area 24 are positioned in a circular arrangement and the access areas thereof, through which work in process is passed into and out of the stations, are located within the work envelope 25 of a robotic arm 26. All work in process is moved between the access areas of the various work stations by the robotic arm 26.

As best seen in FIG. 2, arm 26 comprises an inner arm 31 and an outer arm 32. Inner arm 31 is mounted at one end on a fixed column 27 for rotation in a horizontal plane about a fixed central axis 28. Outer arm 32 is joined at one end to the free end of arm 31 for rotation about a vertical axis 29 that travels in a circular path about axis 28 as arm 31 rotates. A manipulator 33 is mounted in the end of arm 32 opposite axis 29. Manipulator 33 is mounted for rotation about a vertical axis 34 that travels in a path determined by the combined rotations of arms 31 and 32 about the axes 28 and 29, respectively. Manipulator 33 is also mounted in arm 32 for reciprocal vertical motion along axis 34. A gripper device 35 is mounted at the lower end of manipulator 33 along the axis 34. Gripper 35 is designed to grasp and hold multiple units of bobbins simultaneously. A second gripper device 36 is mounted at the lower end of manipulator 33 for vertical reciprocation along a line offset from and parallel to axis 34. Gripper 36 is designed to grasp and hold single bobbin units, as for handling the bad coils which fail to pass the electrical test.

Robotic arms and controllers suitable for use herein are commercially available from several sources. A preferred source of such arms and controllers is Adept Technology, Inc., San Jose, Calif. 95134, U.S.A.

Bulk Unload, Terminal Insertion, and Bobbin Spacing

Figure 3B:
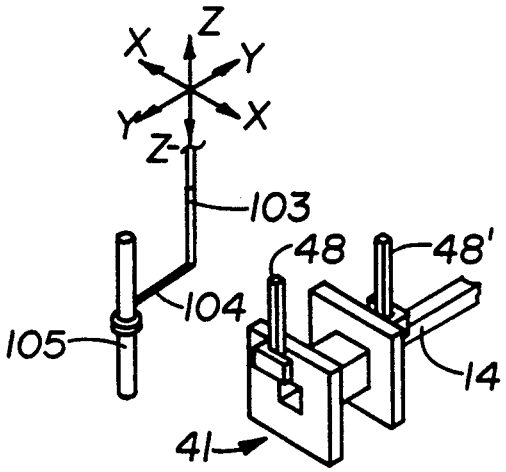
FIGS. 3B–3E are isometric views showing successive steps in the operation of the automatic coil winding machine used in the invention.
Figure 3C:
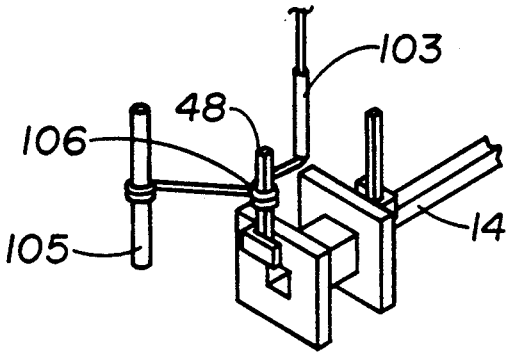
Figure 3D:
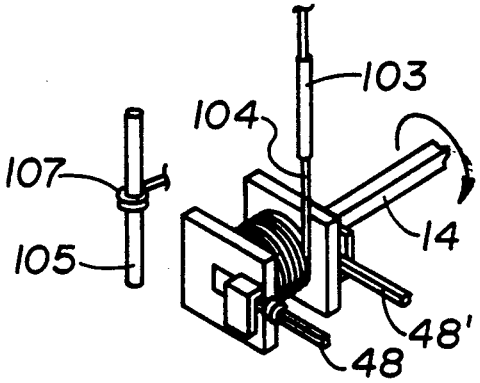

FIG. 3A shows a blank bobbin 41 of a typical form. Bobbin 41 is molded from plastic in a shape having a hollow core 42, ordinarily rectangular in cross section, and two end flanges 43, 43', each with a terminal receiving lub 44, 44'. Referring to FIG. 1, the bobbins 41 are unloaded from a bulk supply into the hopper 45 of a vibratory feeder at work station 10. The bobbins are propelled from hopper 45 by vibration and gravity along an inclined track 46 to pass through a terminal inserter 47. In the course of passage from hopper 45 and along track 46, the bobbins are aligned by suitable deflectors into the attitude shown in FIG. 3A, with the axis of the core 422 lying crosswise of track 46 and with the open ends of lugs 44, 44' upright. Terminal inserter 47 installs a terminal 48, 48' in each of the lugs 44, 44', of each bobbin, as seen in FIG. 3B, and ejects the bobbins onto a conveyer belt 49 without changing the attitude of the bobbins. The bobbins are carried forward by the conveyer belt 49 until the leading bobbin on the belt abuts a stop 51. The following bobbins on the belt are each brought to rest as they encounter a stationary preceding bobbin until a line of stationary bobbins packed flange to flange is presented. Then a bobbin spacer 52, later described in detail, moves towards the belt 49 to insert holding pins in the core openings of a group of bobbins at the belt end and retracts from the belt to a rest position, carrying the impaled bobbins away from the belt. At the rest position, the bobbin spacer 52 elevates the bobbins held thereby to a level above the level of belt 49, in the course of which the bobbins are spaced apart from one another the correct amount for capture by the gripper 35 of the robot arm 26.

Figure 4:
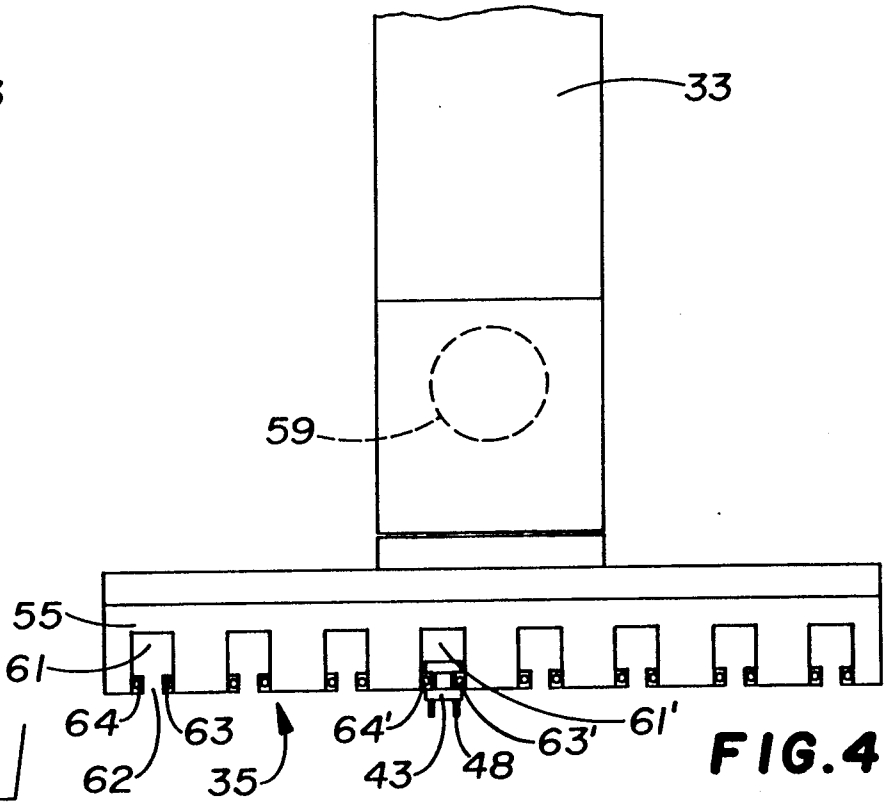
FIG. 4 is a front elevation of the bobbin gripper fitted to the end of the robot arm used for transferring bobbins between the work stations of system of the invention.
Figure 5:
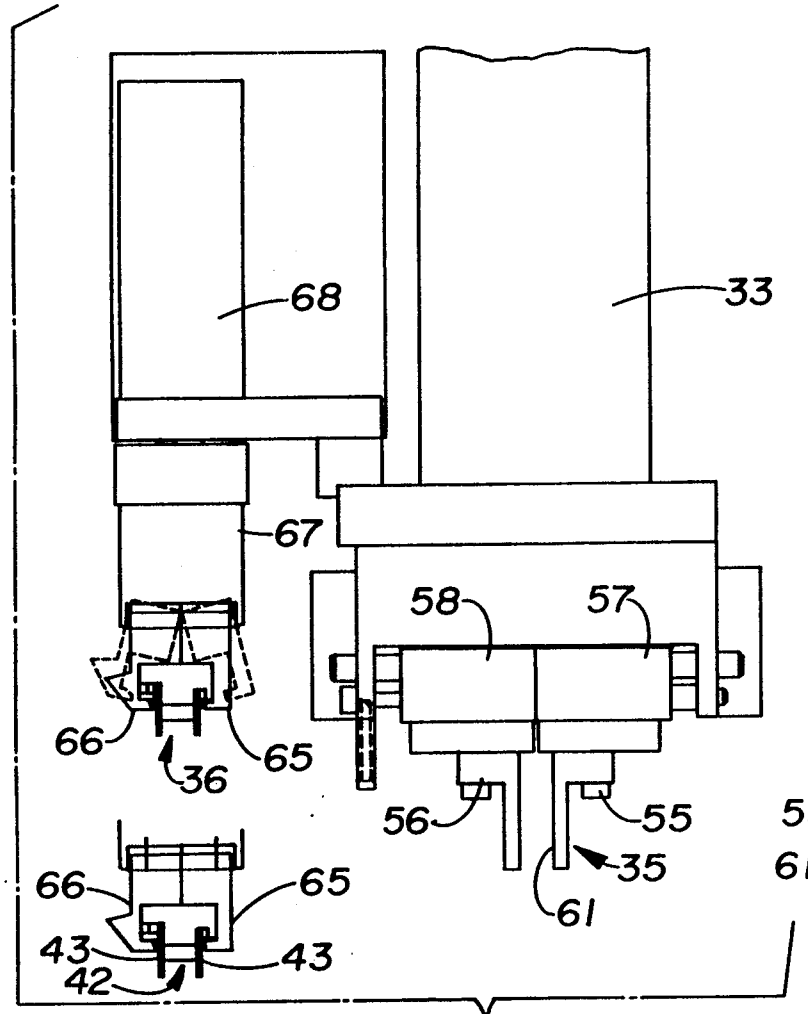
FIG. 5 is a side elevation of the gripper end of the robot arm showing both the multiple bobbin gripper and the single bobbin gripper that are fitted to the arm.

FIGS. 4 and 5 are, respectively, front elevation and side views of the lower portion of manipulator 33 of the robot arm 26 showing the grippers 35 and 36. Gripper 35 comprises two parallel jaws 55, 56 mounted on bearing blocks 57, 58 for sliding motion toward and away from one another. Blocks 57 and 58 are linked to an actuator 59 that controls movement of the blocks, and jaws 55, 56 towards and away from each other. In one specific embodiment of the invention, gripper 35 is designed to handle a group of eight bobbins simultaneously. Each of the jaws 55 and 56 is formed with eight equally spaced rectangular openings 61, one opening for each bobbin. Slots are cut through the lower edges of each of the openings 61 to the lower edge of each of the jaws to provide eight equally spaced, open ended channels 62 lines by oppositely facing legs 63 and 64. An inwardly facing spring loaded detent ball 65 is mounted in each of the legs 63, 64 on jaw 55 to aid in grasping the bobbin retained in each opening.

For clarity, only a single opening 61' is shown occupied by a bobbin of the form seen in FIG. 3. The jaws 55 and 56 are positioned above the bobbin, with the axis of the bobbin lying transversely to the length of the jaws, and the jaws are brought together so that legs 63' and 64' at jaw opening 61' contact the bobbin end flange 43 along opposite sides of the bobbin core opening. Similarly, the legs of the opening in jaw 56 corresponding to opening 61' contact bobbin end flange 43'. The terminals 48 extend below the lower edges jaws 55 and 56.

Referring to FIG. 5, the single bobbin gripper 36 comprises a pair of opposed jaws 65, 66 pivotally mounted in an actuator head 67. Jaws 65 and 66 are movable by the actuator head in a pincer-like fashion so that the facing jaw ends grasp a single bobbin at opposite ends of the bobbin core 42. Actuator head 67 is mounted at the end of the rod of a vertically acting piston 68 secured to the lower end of manipulator arm 33. Piston 68 provides for movement of the gripper 36 above and below the level of gripper 35, as many be necessary to capture or position a single bobbin amidst a group of bobbins.

As is evident from FIG. 4, bobbins must be aligned and evenly spaced at the correct distances to permit handling by the gripper 35. Bobbin spacer 52, shown in FIGS. 6–9, performs the task of removing a group of eight bobbins from the bobbin pack collecting at the stop end of conveyer belt 49 and presenting the group of removed bobbins in alignment at the proper spacing to permit capture by gripper 35.

Figure 6:
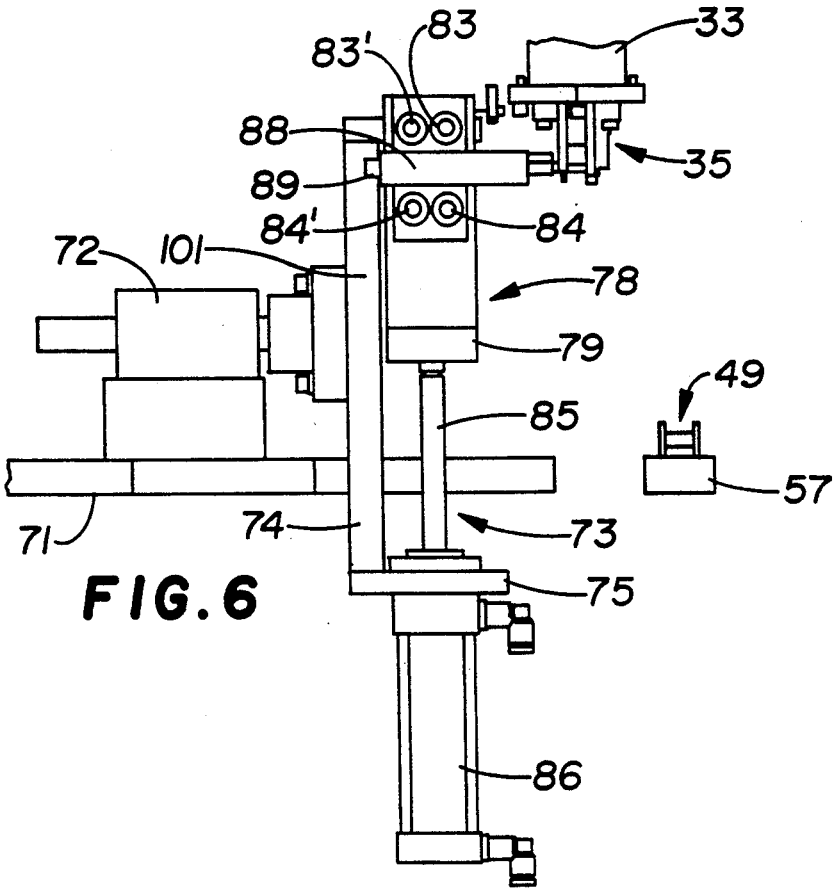
FIG. 6 is a sectional view along the line 6—6 of FIG. 7 of the bobbin spacer used to position blank bobbins at the correct spacing for handling by the gripper of the robot arm.

Referring to FIG. 6, an upright base 71, positioned near the stop end 57 of conveyer belt 49 and spaced laterally away from the belt, supports a horizontally acting piston 72. A frame member 73 is mounted on the end of the rod of piston 72 for movement by piston 72 toward and away from conveyer belt 49. Frame assembly 73 comprises a solid back plate 74 having an outwardly extending flange 75 running the length of the lower edge of the back plate and two outwardly extending ears 76 and 76' fixed to the upper edge at the opposite ends of the back plate. Vertical guide rods 77 and 77' respectively extend from ear 76 to flange 75 and from ear 76' to flange 75. A U-shaped rack member 78 that includes a horizontal bottom plate 79 and vertical end plates 81 and 81' is supported for vertical sliding motion along guide rods 77, 77' by collars 82, 82' fixed to end plates 81, 81' and journaled to rods 77, 77'. A first pair of parallel horizontal guide rods 83, 83' extend between rack end plates 81, 81' near the upper ends of the end plates. A second pair of parallel horizontal guide rods 84, 84' extend between rack end plates 81, 81' below the level of guide rods 83, 83'. Rack member 78 is fixed to the rod 85 of a vertically acting piston 86, the cylinder of which is fixed to the lower flange 75 of frame assembly 73. Piston 86 raises and lowers rack member 78 relative the frame assembly 73.

Figure 7:
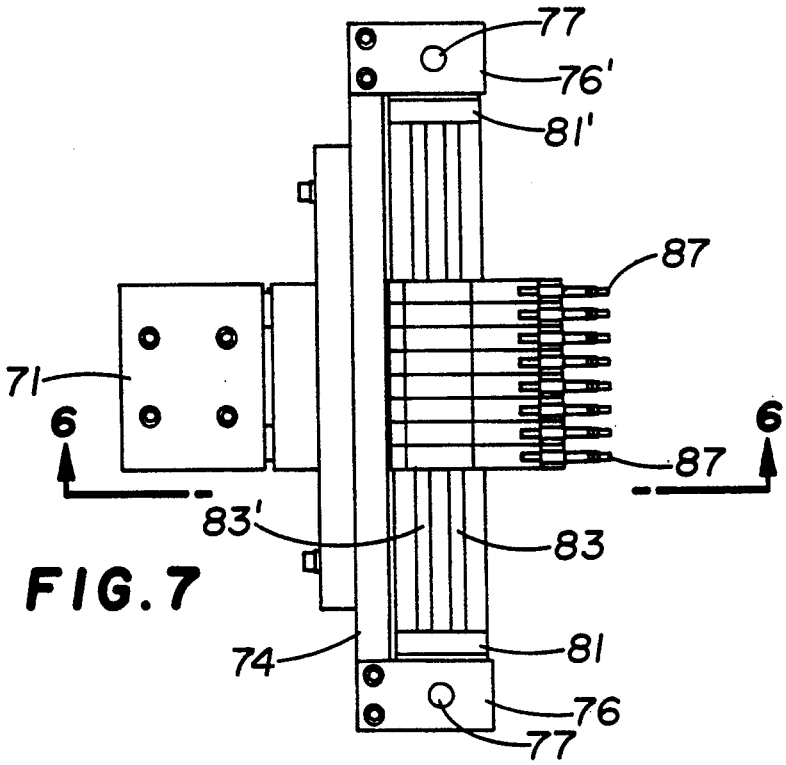
FIG. 7 is a plan view of the bobbin spacer shown in FIG. 6.
Figure 10:
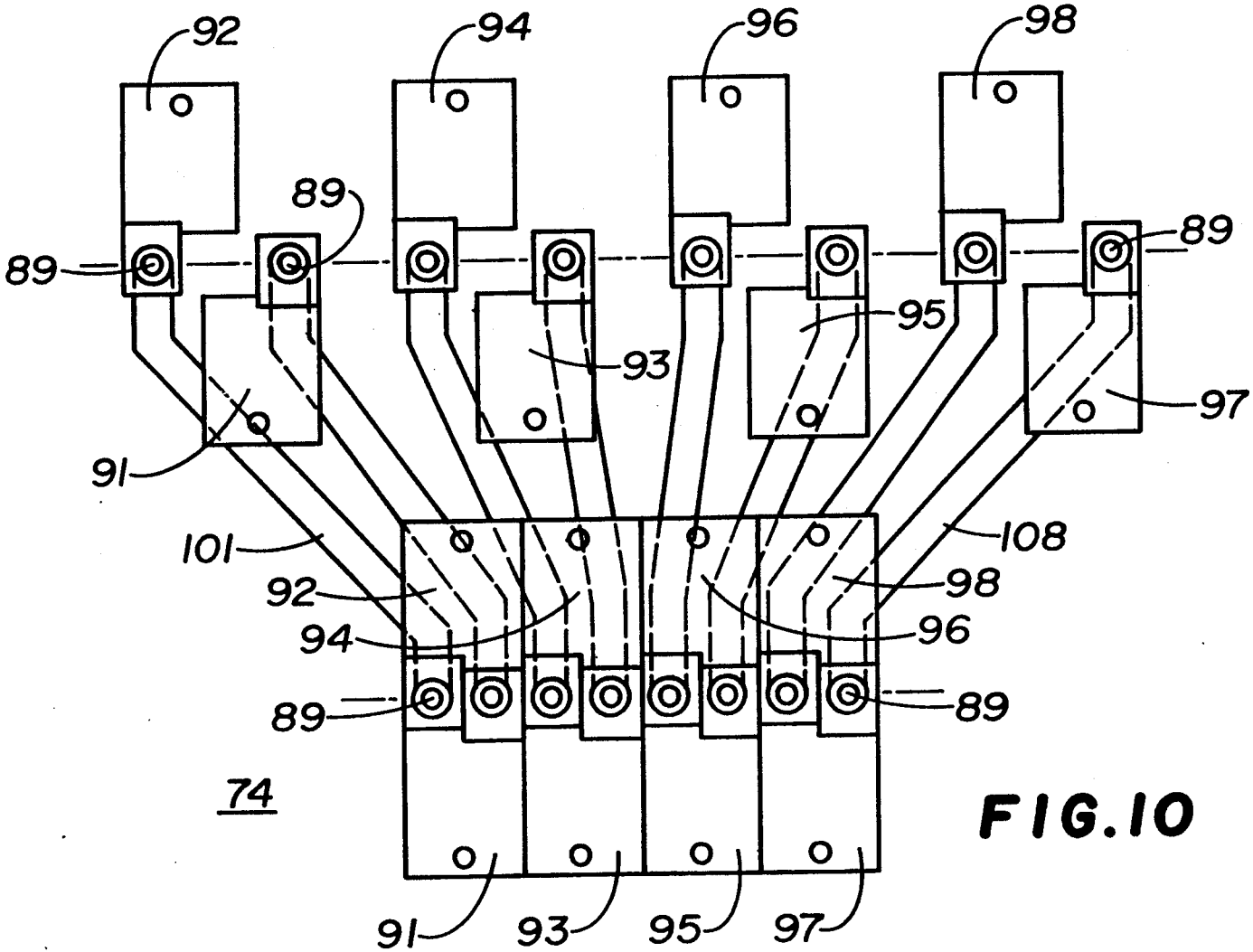
FIG. 10 is a diagram useful in explaining the operation of the bobbin spacer of FIG. 6.

As best seen in FIG. 9, eight tool holder blocks 91–98 are journaled alternately to the lower guide rod pair 84, 84' and to the upper guide rod pair 83, 83' for horizontal sliding motion along the guide rods. That is, blocks 91, 93, 95 and 97 are journaled to rod pair 84, 84' and blocks 92, 94, 96 and 98 are journaled to rod pair 83, 83'. A tool holder 88 is fixed to each of the blocks 91–98 on the facing surfaces of the blocks. Each of the holders 88 extend the length of its mounting block, transversely to the guide rods 83, 84 and the width of each of the tool holders is approximately equal to one-half the width of a mounting block. As best seen in FIGS. 6 and 7, each tool holder 88 carries at its forward end a bobbin holding pin 87, shaped to fit the core opening of a bobbin on conveyer belt 49, and carries at its rearward end a guide pin 89 aligned with the axis of pin 87. As is shown diagrammatically in FIG. 10, the guide pin 89 of each of the tool holders on blocks 91–89 fits into an individual angled track 101–108 cut in the front surface of back plate 74 of frame assembly 73.

Tracks 101–108 are convergent towards the lower edge of back plate 74 so that when rack member 78 is in a lowered position relative to frame assembly 73, as in FIG. 8, the mounting blocks are brought together, with blocks 92–98 respectively vertically aligned with blocks 91–97. The bobbin holding pins 87 then all lie on the same level with the spacings therebetween being equal to the spacings between the core openings of the bobbins packed together at the stop end of conveyer belt 49.

With the rack member 73 in the lowered position of FIG. 8, piston 72 advances the frame assembly 73 towards the conveyer belt 49 until the eight bobbin holding pins 87 each capture a bobbin from the line of bobbins at the belt end 57. Piston 72 then retracts the frame assembly 73 from the belt 49 and piston 86 raises the rack member 78 to the position shown in FIG. 9. The bobbin removed from the conveyer belt and held by the holding pins 87 are then aligned and correctly spaced for capture by the gripper 35 of the robot arm 26. Manipulator 33 lowers the gripper 35 over the bobbins, grasps the bobbins and moves forward to remove the eight bobbins from the holding pins 87, whence robot arm 26 carries the group of bobbins to work station 12 and installs the bobbin group on the indexer-loader 3 of the coil winding machine 15.

Coil Winding Machine

Figure 3E:
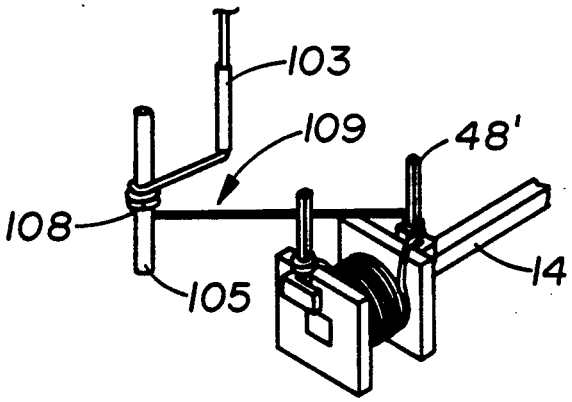

Coil winding machines of the type used herein have been used commercially in prior automated coil winding systems. The basic operation of such machines can be understood from the diagrams of FIGS. 3B∝3E. Referring to FIG. 1, a wire to be wound on a bobbin is fed from a supply spool 101 through a tensioning arm 102 into a guide nozzle 103 (FIG. 3B) that is adjacent to one of the spindles 14 of the winding machine 15. In a specific embodiment, there are sixteen separate wire supply spools 101, guide nozzles 103, and spindles 4 for winding sixteen bobbins simultaneously. Referring to FIG. 3B, a bobbin 41 is shown installed on a spindle 4 by the indexer-loader 13 of the winding machine, as later described. The wire 104 from a supply spool passes through the guide nozzle 103 and, initially, the wire end is wrapped around a stationary post 105 near the spindle 14. The guide nozzle 103 is steerable in three dimensions along the axes X—X, Y—Y and Z—Z under the control of the winding machine. After a blank bobbin is installed on the spindle, the nozzle is steered to wrap the wire around bobbin terminal 48, as seen at 106 in FIG. 3C. Then the spindle 14 is rotated, breaking the wire at post 105 (107-FIG. 3D) on the first spindle turn, while the end of the wire 104 from the supply spool is secured to terminal 48 by the wire wrap 106. Spindle 14 continues to turn while nozzle 104 is steered to guide the wire onto the bobbin as the coil is being built up. In the meantime, wire wrap 107 is removed from post 105 by means not shown in FIGS. 3B–3E. Referring to FIG. 3E, after the desired number of turns have been placed on the bobbin, spindle rotation is stopped and the nozzle is steered to wrap the wire at the coil end around terminal 48′ and then to carry the wire back to post 105 and form a wire wrap 108 around post 105. The would bobbin is returned to the indexer-loader 13 for removal by the robot arm 26, breaking the wire at 109, and preparing the machine to receive another blank bobbin, as in FIG. 3B.

Figure 11A:
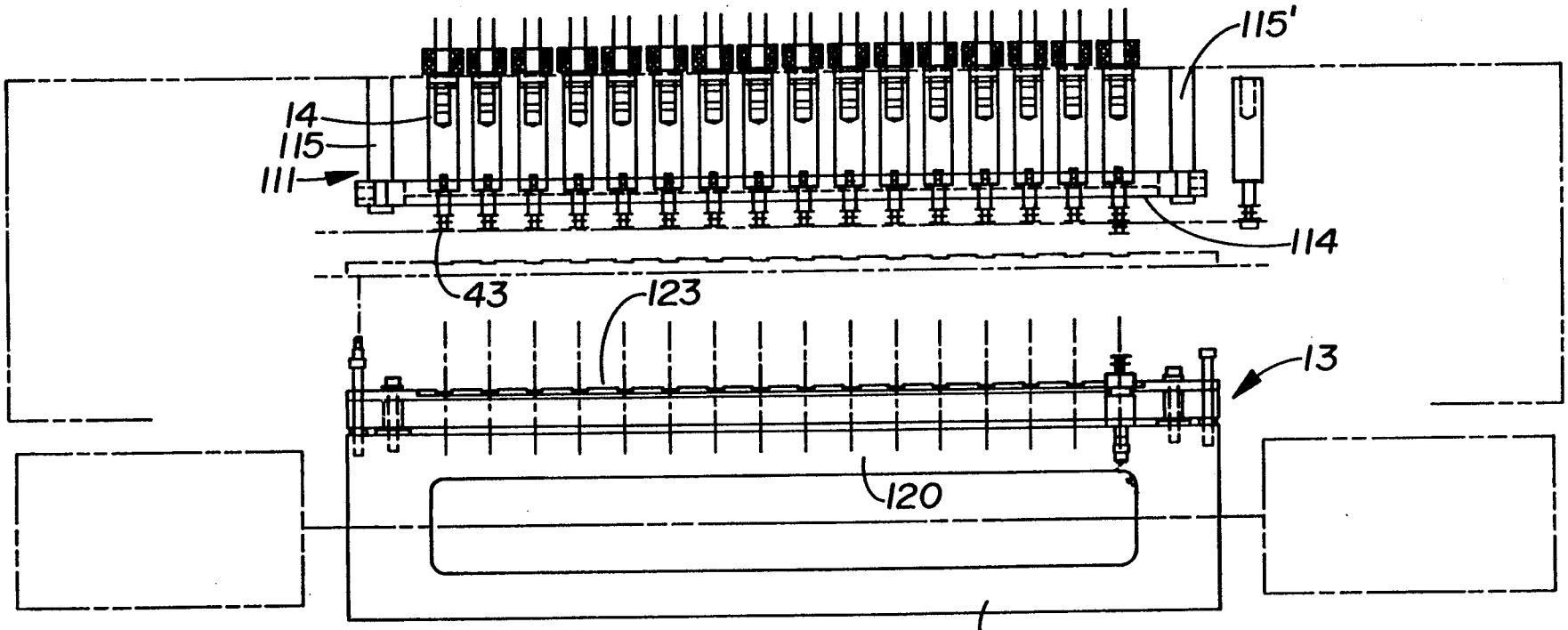
FIG. 11A is a plan view of the spindle area of the coil winding machine used in the invention.
Figure 11B:
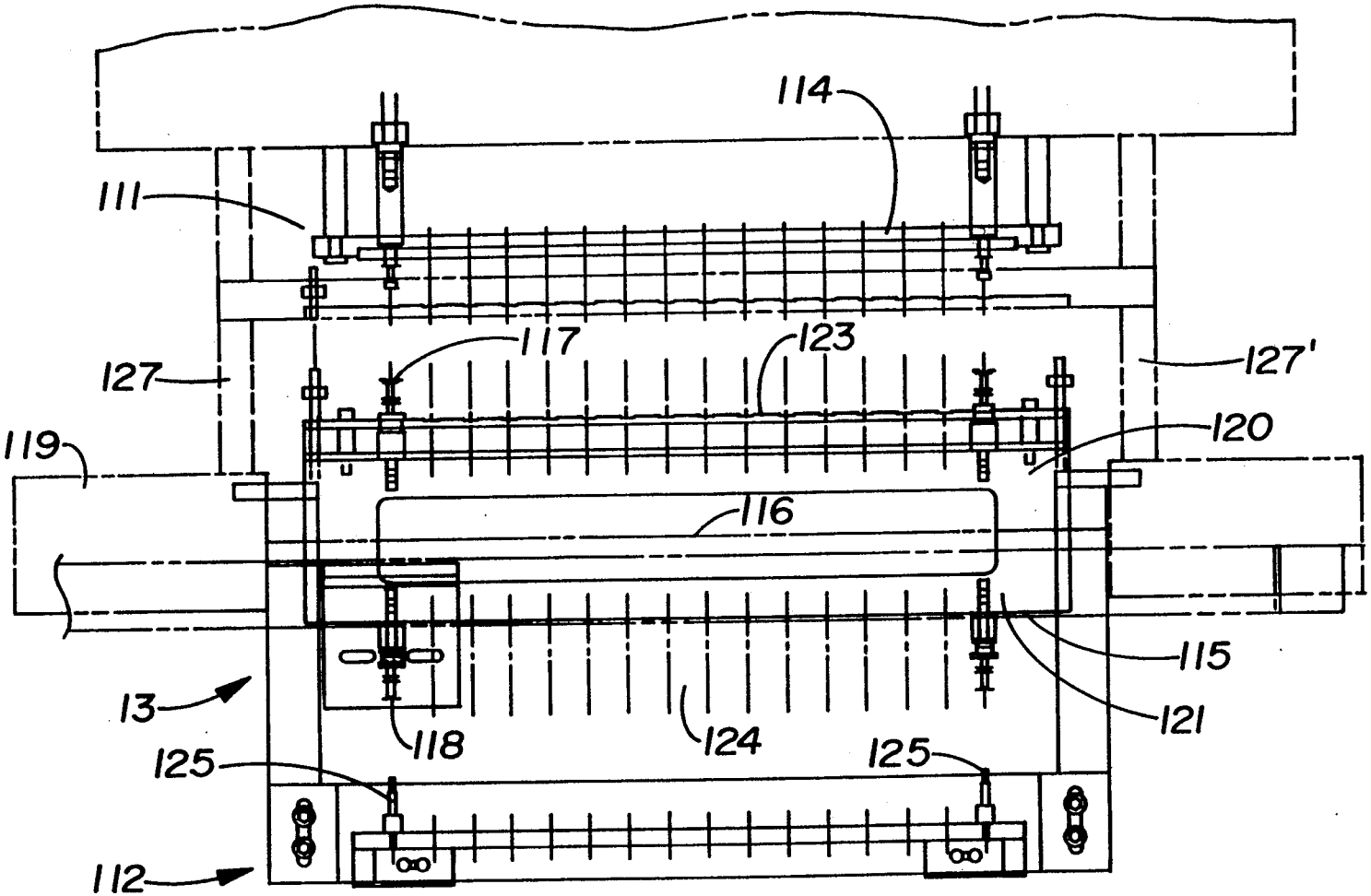
FIG. 11B is a plan view of the spindle area of the coil winding machine, the indexer-loader, and the buffer rack thereof.
Figure 12:
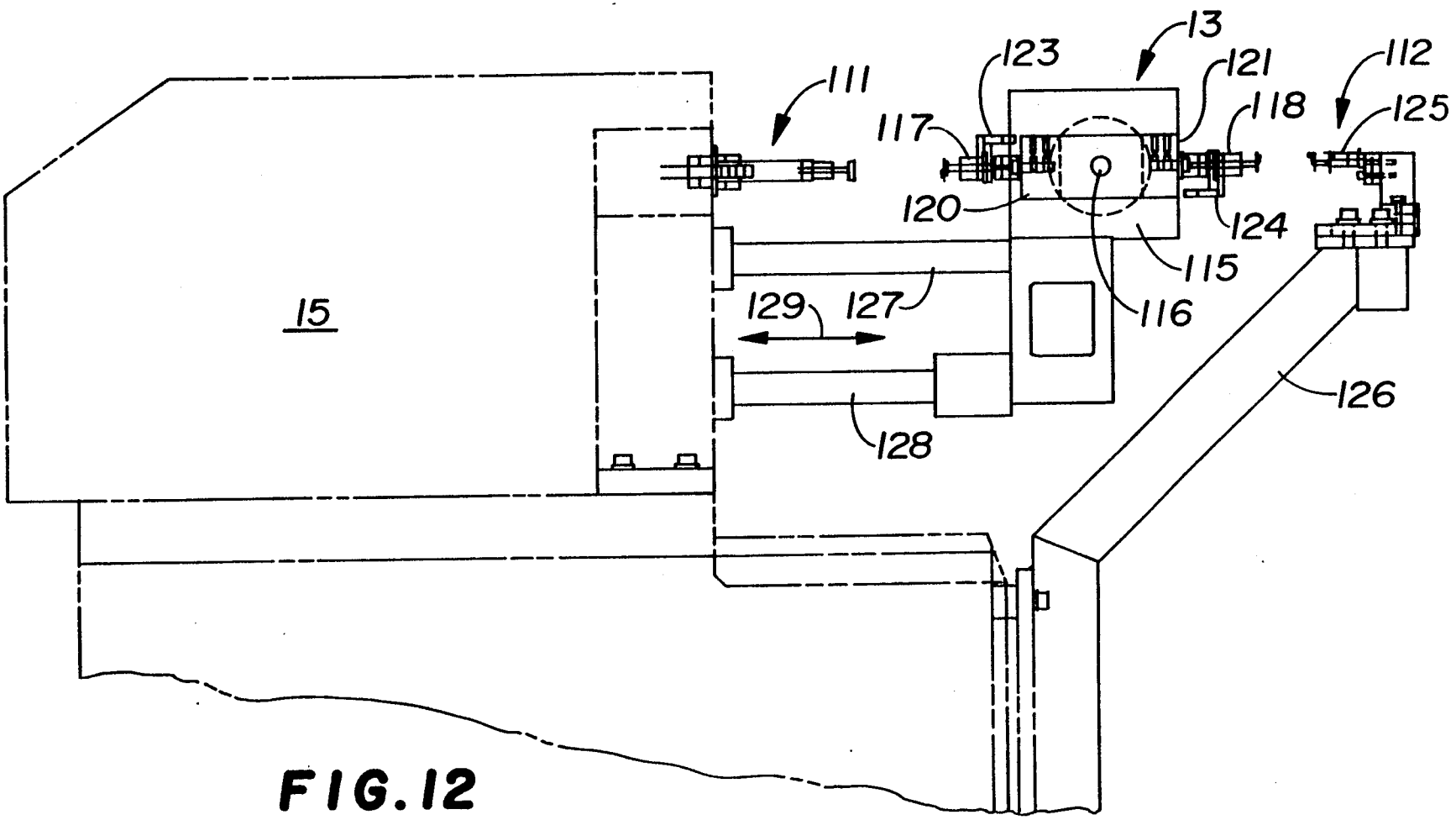
FIG. 12 is a side elevation of the spindle area of the coil winding machine, the indexer-loader, and the buffer rack thereof.

FIGS. 11A is a plan view of the spindle area 111 of winding machine 15 with a portion of indexer-loader 13. FIG. 11B is a plan view of spindle area 111, indexer-loader 13 and a buffer rack 112 onto which indexer-loader 13 may install wound bobbins for temporary holding. FIG. 12 is a side view of spindle area 111, indexer-loader 3 and buffer rack 112. Referring to FIGS. 11A, 11B and 12, each of the spindles 14 includes at its forward end a pin shaped to fit into the core opening of a bobbin to retain the bobbin thereon. A comb-like stripper bar 114 extends across the row of spindles with the bobbin holding pins of the spindles protruding forward between the teeth of the stripper bar 114. Bar 114 is mounted on shafts 115, 115′ for movement forward away from the ends of the spindles 14 so that forward movement of bar 14 causes the teeth of the bar to engage the rear flanges of bobbins installed on the spindles in front of the bar and push the bobbins off the spindle holding pins.

Indexer-loader 13 comprises a rectangular frame 115 mounted on a shaft 116 for rotation of frame 115 through 180°. Sixteen bobbin holding pins 17 are mounted along one side 120 of frame 115 on the same center lines as the bobbin holding pins of spindles 14. Similarly, sixteen bobbin holding pins 118 are mounted along the opposite side 121 of frame 115 in alignment with pins 17. Indexer 13 includes an actuator 119 for rotating frame 115 about shaft 116 under the direction of the system controller. Stripper bars 123 and 124, similar to stripper bar 114, are respectively mounted across the row of holding pins 117 and across the row of holding pins 118 for pushing the bobbins installed on pins 117 and 118 off the pins at the appropriate times. Buffer rack 112 comprises sixteen bobbin holding pins 125 supported in alignment with pins 118 by brackets 126 at a position forward of and facing the free ends of pins 118.

Indexer 13, including frame 115, shaft 116 and actuator 119 is mounted on shafts 127 and 128 for horizontal reciprocal motion along the line 129 until the free ends of holding pins 117 are brought into near contact with the free ends of the bobbin holding pins on the spindles 14 and, in the reverse direction, until the free ends of pins 118 are brought into near contact with the free ends of pins 125.

Initially, with indexer 13 in the mid-position seen in FIGS. 11B and 12, robot arm 26 captures a first group of eight bobbins from bobbin spacer 52, carries the group to the front of side 121 of indexer frame 115 and installs the bobbins on the first eight of the holding pins 118. In like manner, the robot arm installs a second group of bobbins on the remaining eight of pins 118. When pins 118 are loaded with a full complement of bobbins, frame 115 is rotated 180° on shaft 16 to bring pins 118, loaded with bobbins, into facing relationship with the spindles 14. Indexer 13 is retracted on shafts 127, 128 toward the spindles 14 until the bobbin holding pins of the spindles are closely adjacent to the core openings of the bobbins on pins 118. Stripper bar 122 is actuated to push the bobbins from 118 onto the holding pins of the spindles, and indexer 13 is returned to mid-position. Frame 15 is then inverted from the initial position so that pins 117 face the buffer rack 112. The robot arm 26 proceeds to load pins 117 with a complement of bobbins while coils are being wound on the bobbins just transferred from the pins 118 to the spindles 14. When coils are wound on the initial batch of bobbins, indexer 13 is retracted toward the spindles 14 to bring the then unoccupied pins 118 into near contact with the wound bobbins on the spindles and stripper bar 114 is actuated to push the wound bobbins onto the pins 118. Frame 15 is rotated 180° to bring the empty bobbins on pins 117 into position for loading onto the spindles 114, the bobbins are loaded from pins 117 onto the spindles by actuating stripper bar 123, and the indexer is returned to mid-position with pins 118 occupied by wound bobbins. Robot arm 26 removes a group of eight wound bobbins from pins 118 and carries them to the receiving fixture 21 at the flux-solder station 17, returns with from bobbin spacer 52 with eight empty bobbins and installs them on the eight unoccupied pins 118, removes the eight remaining wound bobbins from pins 118 and carries them to the receiving fixture 21, which has been cleared by the pick and place mechanism 22 during the return trip of arm 26.

Buffer rack 112 provides a place for temporarily storing wound bobbins if production rates require prompt loading of indexer 13 with empty bobbins. Indexer 13 is extended on shafts 127, 128 until the pins 117 or 118 holding the wound bobbins are in near contact with the holding pins 125 of buffer rack 112. The appropriate stripper bar 123 or 124 is actuated to push the wound bobbins on to pins 125 and the indexer 13 is returned to mid-position. Robot arm 26 then transfers the wound bobbins from buffer rack 112 to the flux-solder receiving fixture 21.

Flux, Solder and Test Station

Figure 13:
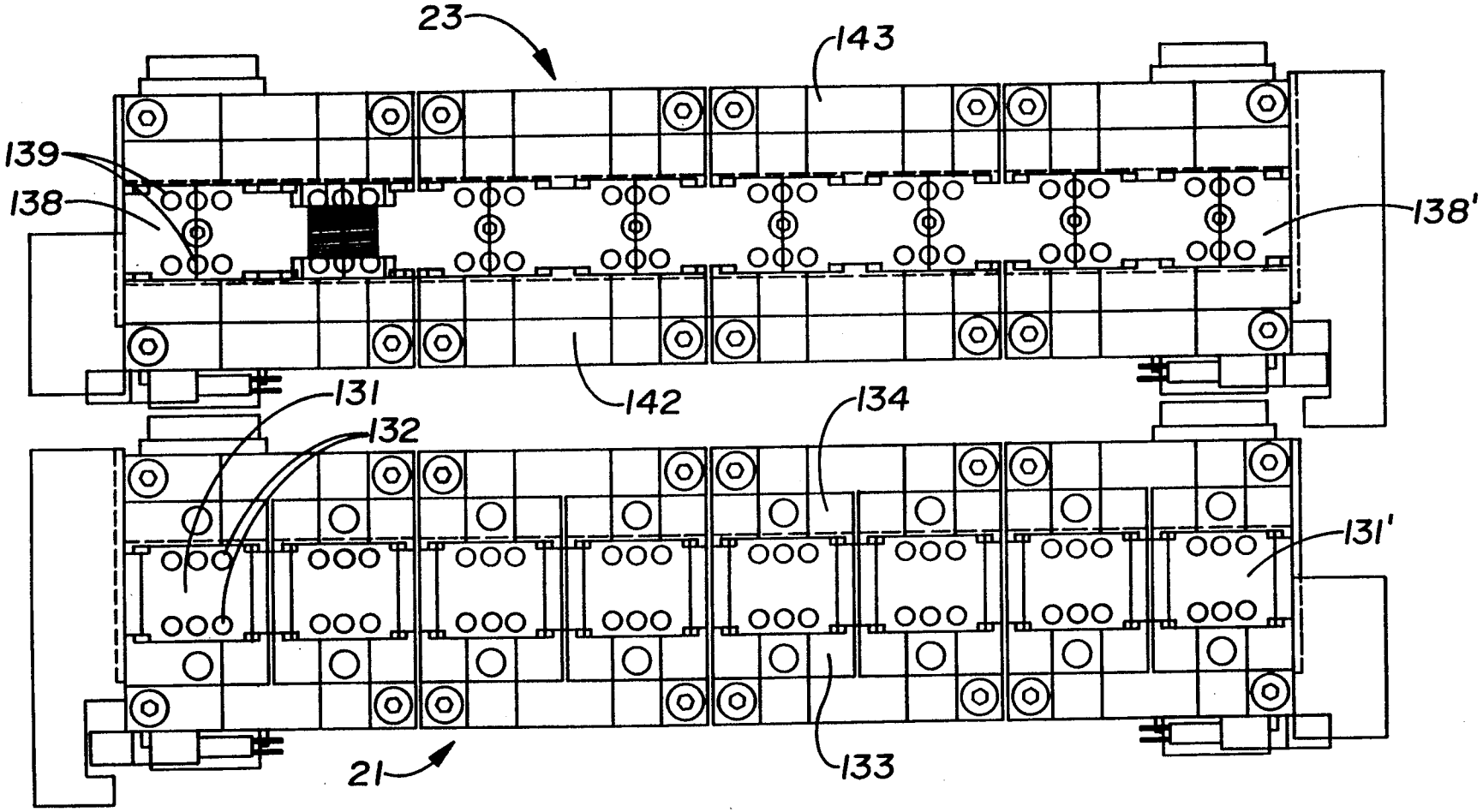
FIGS. 13 and 14 are, respectively, plan and end elevation views of the receiving fixture and test fixture used at flux, solder and test work station of the system of the invention.
Figure 14:
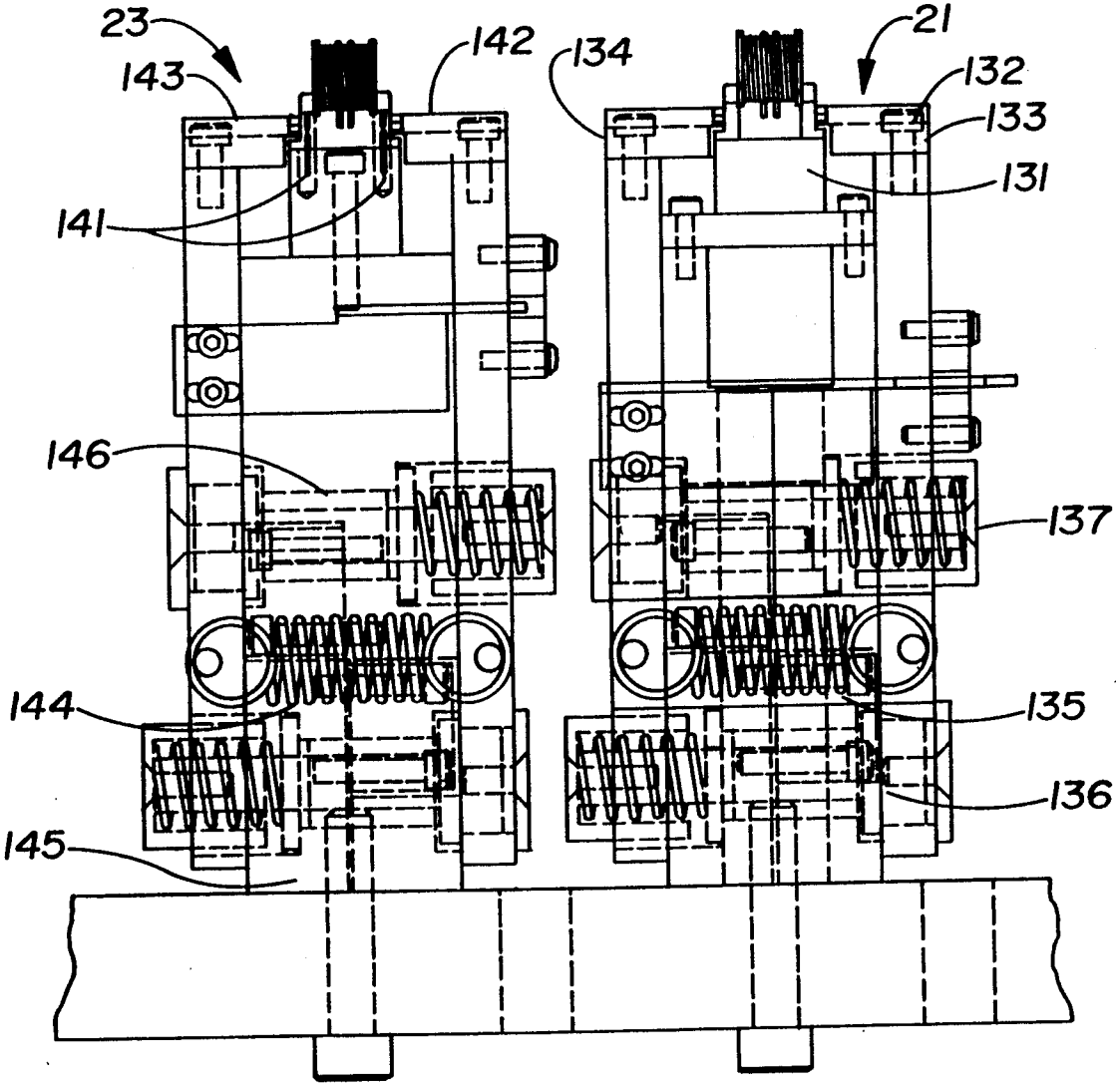

FIGS. 13 and 14 are plan and end views of the receiving fixture 21 and test fixture 23. Fixture 21 comprises a base supporting eight aligned bobbin receiving blocks 131—131' that are spaced at the same distances as are the openings 61 of the gripper 35 of robot arm 26. Each of the blocks 131 is provided with openings 132 to receive the bobbin terminals 48 when a bobbin is placed on the block with the bobbin end flanges extending perpendicular to the block and the bobbin coil running crosswise to the block. More than two of the openings 132 are provided in each block to accommodate bobbin styles having different terminal locations. Jaws 133 and 134 extend along opposite sides of the line of blocks 131 for releasably engaging the end flanges of bobbins placed the blocks. The jaws 133 and 134 are loosely mounted and are biased toward each other by tension springs 135. Actuators 136 and 137, positioned on opposite sides of the springs 135, expand jaws 133 and 134 horizontally whenever it is desired to position bobbins on the blocks 131 or to release bobbins held thereon by the jaws.

Test fixture 23 comprises a row of eight bobbin receiving positions 138—138', similar to blocks 131 except that positions 138 are formed from insulating material and each of the terminal receiving openings 139 at each position 138 has imbedded therein an electrical contact 141 that communicates with test apparatus (not shown). The positions 138—138' are laterally aligned with blocks 131—131' at the same spacings as blocks 131—131'. Fixture 23 is similar to fixture 21, except as noted, and includes opposed jaws 142 and 143, tension springs 144, and actuators 145 and 146 for releasing jaws 142 and 143 at the appropriate times.

Figure 15:
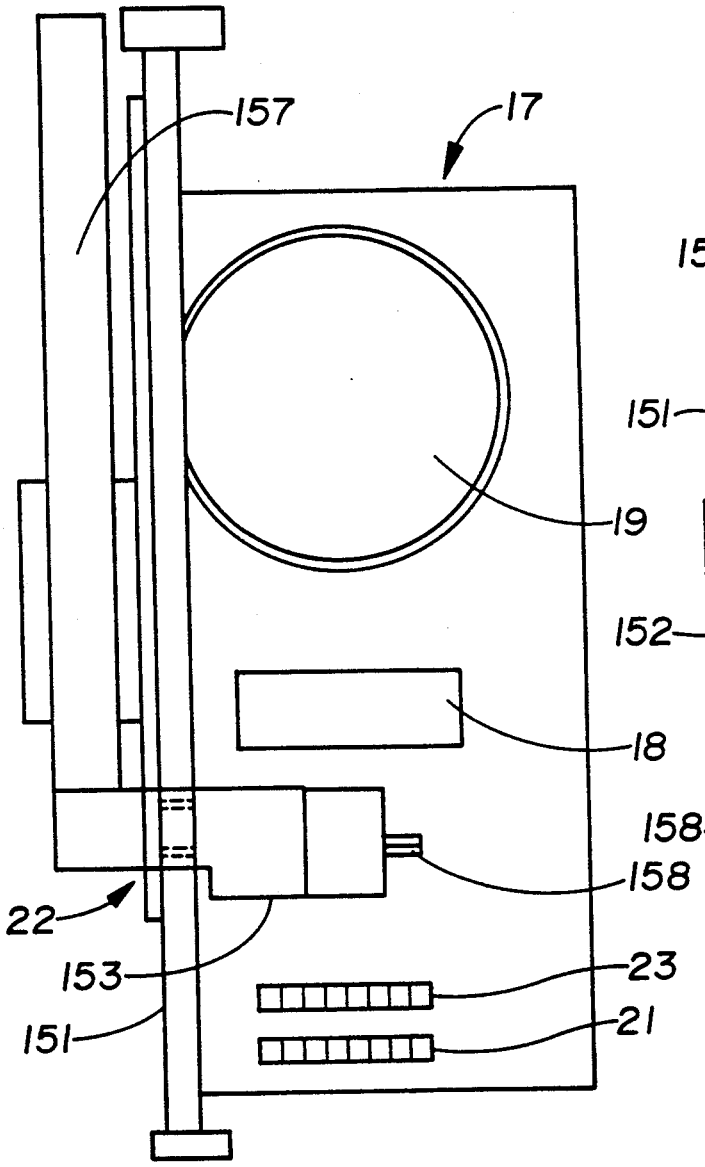
FIG. 15 is a plan view of the flux, solder and test work station of the system.

Fixtures 21 and 23 are positioned in line with flux bath 18 and solder bath 19 along the line of travel of pick and place mechanism 22, as seen in FIG. 15, which is a plan view of the flux, solder and test work station 17. Wound bobbins transferred to fixture 21 by robot arm 26 are removed as a group from fixture 21 by the pick and place mechanism 22, carried to the flux bath 18 where the bobbin terminals are immersed in flux, then carried to the solder bath 19 where the bobbin terminals are immersed in solder, and finally placed in test fixture 23. The bobbins removed from fixture 21 are held by the pick and place mechanism during fluxing and soldering and until they are placed in fixture 23.

Figure 16:
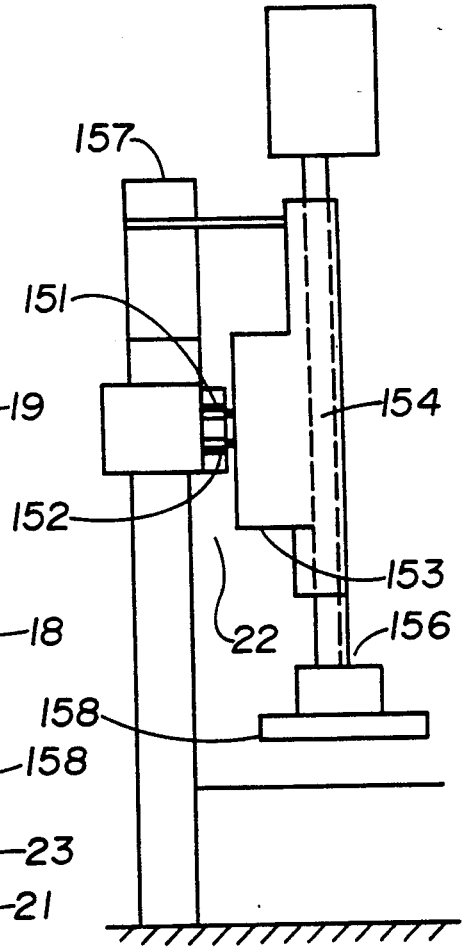
FIG. 16 is a front elevation of the pick and place mechanism used for handling wound bobbins at the flux, solder and test work station of the system.
Figure 17:
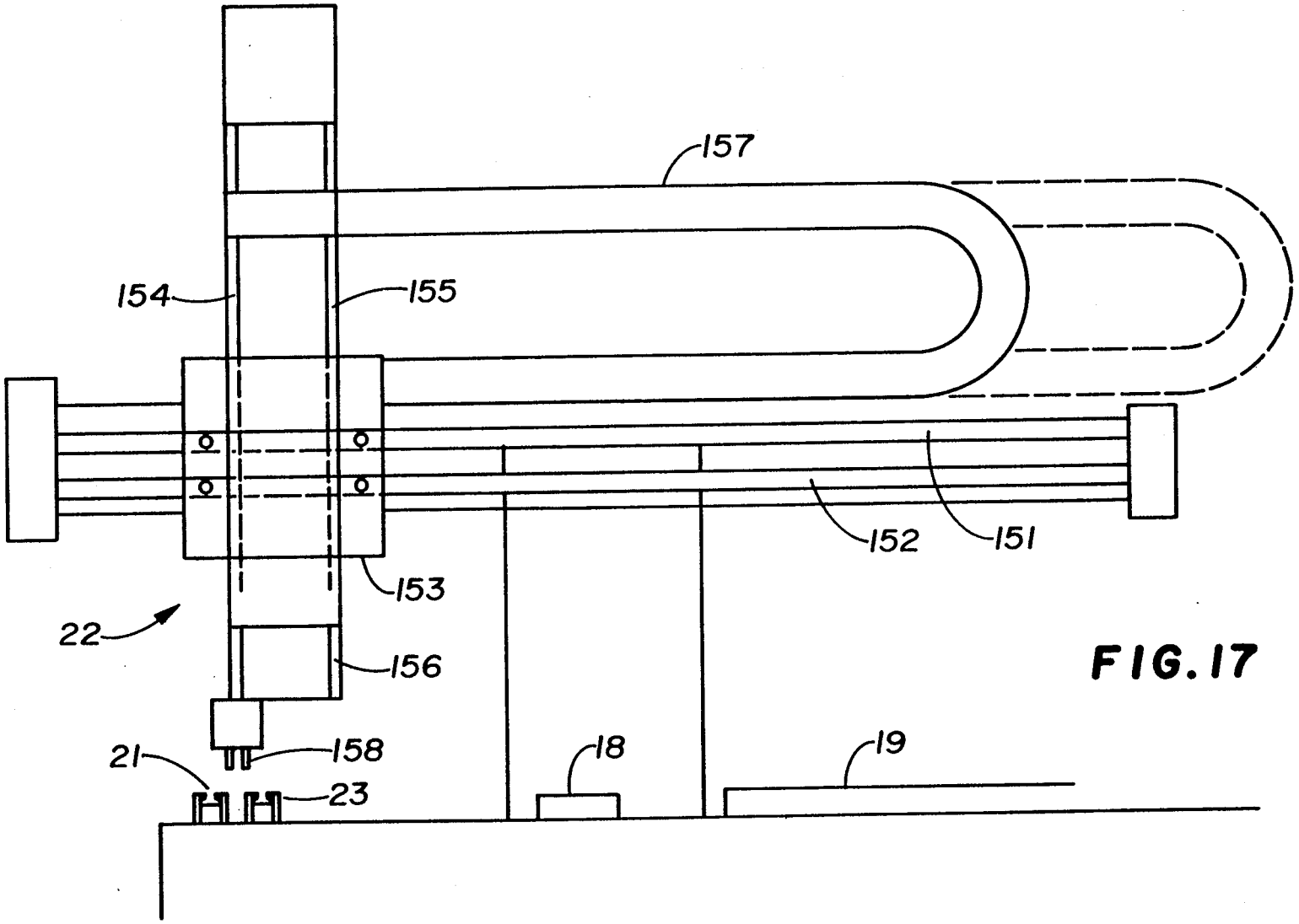
FIG. 17 is a side elevation of the pick and place mechanism shown in FIG. 16.

FIGS. 16 and 17 are front elevation and side elevation views of pick and place mechanism 22. Referring to FIGS. 15–17, pick and place 22 comprises a pair of horizontal rails 151, 152 supported alongside work station 17 above the surface of fixtures 21, 23, flux bath 18 and solder bath 19. A horizontal carriage 153 is mounted on rails 151 and 152 and is driven along the rails by a servomotor (not shown) under the command of the system controller. Carriage 153 carries a pair of vertical rails 154 and 155 upon which a vertical carriage 156 is mounted. Carriage 156 is driven vertically along rails 154 and 155 by a servomotor (not shown) under the command of the system controller. Power supply and control signal lines are connected to carriage 156 through a flexible conduit 157. A gripper 158, similar to gripper 35 of robot arm 26, is mounted on the lower end of vertical carriage 156 for grasping and holding a group of eight bobbins.

After a group of wound bobbins is deposited in fixture 21 by robot arm 26, pick and place 22 moves carriage 153 over fixture 21 and carriage 156 descends to grasp the group of bobbins in gripper 158, then raises to remove the bobbin group from fixture 21. Pick and place 22 moves carriage 153 over the flux bath 18, and carriage 156 descends to immerse the bobbin terminals in flux. The bobbins are held by gripper 158 during fluxing. After a suitable dwell time, carriage 156 rises and carriage 153 moves over the solder bath 19. Carriage 156 descends to immerse the bobbin terminals in solder while gripper 158 continues to hold the bobbins. Carriage 56 rises after a suitable dwell and carriage 153 moves over the test fixture 23. Carriage 156 descends to place the soldered bobbins in fixture 23, which grasps the soldered bobbins, and the bobbins are released by gripper 158. The bobbins in fixture 23 are tested electrically and those positions of fixture 23 containing faulty bobbins are identified to the system controller. The system controller directs robot arm 26 to remove any faulty bobbins from fixture 23, using the single gripper 36, and place them in a segregated portion of unload area 24. Good bobbins are removed as a group from fixture 23 by robot arm 26, using gripper 35, and are carried to unload area 24, completing the manufacturing process.

Figure 18:
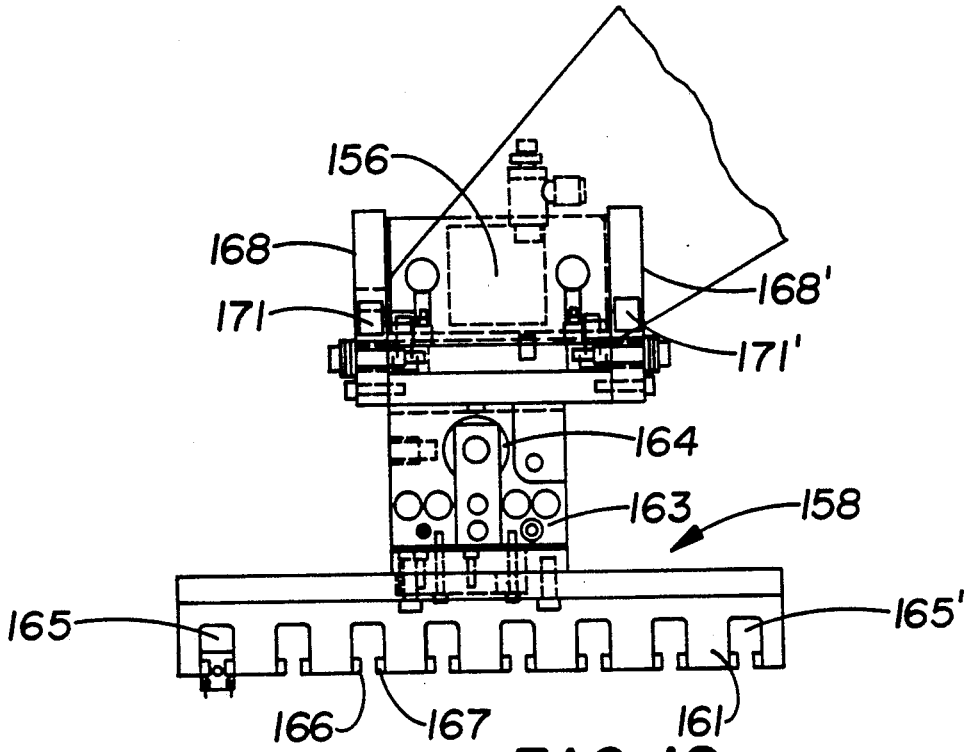
FIG. 18 is a front elevation of the bobbin gripper portion of the pick and place mechanism shown in FIG. 16.
Figure 19:
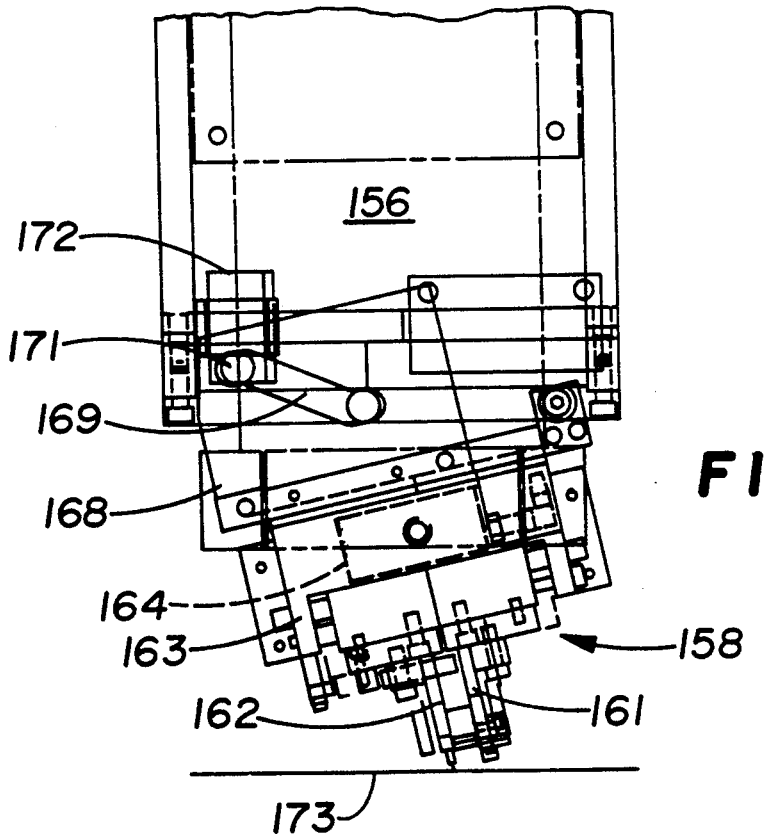
FIG. 19 is a side elevation of the bobbin gripper shown in FIG. 18.

FIGS. 18 and 19 are front and side elevation views of gripper 158. Gripper 158 comprises a pair of jaws 161 and 162 mounted on an actuator head 163 for sliding toward and away from each other under the control of an actuator 164 contained in head 163. Like the jaws of gripper 35, jaws 161 and 162 are formed with eight slotted openings 165—165' identically shaped to the openings 61 of gripper 35, including inwardly facing legs 166 and 167, corresponding to legs 63 and 64 of gripper 35. The openings 165—65' are evenly spaced at the same distances as are the openings 61 of gripper 35 so that gripper 158 grasps and holds the bobbins in the same manner as gripper 35.

Actuator head 163 is pivotally mounted to carriage 156 along the front edge of the head. Rectangular cam plates 168, 168' mounted on the sides of head 163 extend above head 163 along the sides of carriage 156. Each of the cam plates 168, 168' contain an angled slot 169 into which a cam follower pin 171, 171' extends from an actuator 172 mounted in carriage 156. Actuator 172 travels horizontally, parallel to the sides of carriage 156, and in so doing moves the actuator head 163 from a position in which the jaws 161 and 162 are vertical, with the pins 171, 171' at the lower ends of cam slots 169, to a position in which the actuator head is tilted, as seen in FIG. 19. The tilted position of the actuator head 163 is useful for immersing in the flux and solder baths those styles of bobbins that have both terminals mounted in the same bobbin end flange and the opposite bobbin end flange extends below the level of the terminals. Such a bobbin style is shown in FIG. 19 and the level of the flux or solder bath is indicated by the line 173.

Other means for fluxing and soldering the terminals of bobbins having a style such that the bobbin end flanges may interfere with bath immersion have been used in prior automated coil winding systems and such means are also applicable to the present invention. For example, the flux and solder baths may each contain a row of cups that are normally submerged beneath the surface of the bath. A group of bobbins is brought over the cups with the terminals of the bobbins lying close to the edges of the cups. Then the cups are raised above the surface of the bath to immerse the terminals, while the bobbin flanges opposite the terminals are outside the rims of the cups and are clear of the bath.

Pick and place mechanisms similar to pick and place mechanism 22, but with different forms of grippers, have been used in prior automated coil winding systems. Also, flux baths and solder baths similar to flux bath 18 and solder bath 19 have been used in prior automated coil winding systems. In both prior systems and in the present invention, means are provided for automatically replenishing the supplies of flux and solder so as to maintain the flux and solder baths at constant levels during system operation. Obviously, variations and modifications in the invention are possible in light of the above teachings. It is to be understood that the invention may be practiced otherwise than as specifically disclosed without departing from the spirit and scope of the appended claims.

We claim:

1. The method for automatically producing electrical coils, each said coil having a bobbin, a plurality of turns of wire wound on said bobbin and at least two terminals, the start end of said turns of wire being soldered to one of said terminals, the finish end of said turns of wire being soldered to the other of said terminals, said method comprising:

establishing a first work station for automatically performing the tasks of:

presenting a stream of bobbins each having at least a first and second terminal, and each of said bobbins being in a predetermined attitude and; and establishing a second work station for automatically performing the tasks of, with respect to each bobbin delivered to said second station from said first station:

winding a plurality of turns of wire on each said delivered bobbin;

wrapping the start end of said plurality of turns of wire around said first terminal; and wrapping the finish end of said plurality of turns of wire wound said second terminal;

establishing a third work station for automatically performing the tasks of, with respect to each bobbin delivered to said third station from said first station;

immersing said first and second terminals in flux;

immersing said first and second terminals in solder; and electrically testing the coils after immersion of said terminals in solder;

providing a robotic arm of a type wherein the arm rotates in a horizontal plane about a fixed central axis and grasping means are provided at the free end of the arm;

positioning said first, second and third work stations within the periphery of the locus of travel of the free end of said robot arm; and transferring by means of said robotic arm, bobbins from said first work station to said second work station, bobbins from said second work station to said third work station and bobbins from said third work station to an area for disposal.

2. A method as claimed in claim 1 wherein operations of said first, second, and third work stations, and said robotic arm are conducted under the command of a central controller.

3. The method for automatically producing electrical coils, each said coil having a bobbin, a plurality of turns of wire wound on said bobbin and at least two terminals, said turns of wire having a start end and a finish end, said method comprising:

establishing a first work station for automatically performing the tasks of:

presenting a stream of bobbins each having at least a first and second terminal, and each of said bobbins being in a predetermined attitude and; and establishing a second work station for automatically performing the tasks of, with respect to each bobbin delivered to said second station from said first station;

winding a plurality of turns of wire on each said delivered bobbin;

wrapping the start end of said plurality of turns of wire around said first terminal; and wrapping the finish end of said plurality of turns of wire around said second terminal;

establishing a third work station for automatically performing the tasks of, with respect to each bobbin delivered to said third station from said first station;

electrically connecting the start end of said turns of wire to one of said terminals and the finish end of said turns of wire to the other of said terminals;

electrically testing the coils after said electrical connection step;

providing a robotic arm of a type wherein the arm rotates in a horizontal plane about a fixed central axis and grasping means are provided at the free end of the arm;

positioning said first, second and third work stations within the periphery of the locus of travel of the free end of said robot arm; and transferring by means of said robotic arm, bobbins from said first work station to said second work station, bobbins from said second work station to said third work station and bobbins from said third work station to an area for disposal.

4. A method as claimed in claim 3 wherein operations of said first, second, and third work stations, and said robotic arm are conducted under the command of a central controller.

5. An apparatus for automatically producing electrical coils, each said coil having a bobbin, a plurality of turns of wire wound on said bobbin and at least two terminals, the start end of said turns of wire being soldered to one of said terminals, the finish end of said turns of wire being soldered to the other of said terminals, said apparatus comprising:

a robotic arm of a type wherein the arm rotates in a horizontal plane about a fixed central axis and grasping means are provided at the free end of the arm;

a first work station positioned within a periphery of a locus of travel of the free end of said robot arm for automatically performing the task of, presenting a stream of bobbins, each of said bobbins having at least a first and second terminal, and each of said bobbins in said stream being in a predetermined attitude, and a second work station positioned within the periphery of the locus of travel of the free end of said robot arm for automatically performing the tasks of, winding a plurality of turns of wire on each said delivered bobbin, wrapping the start end of said plurality of turns of wire around said first terminal, and wrapping the finish end of said plurality of turns of wire around said second terminal;

a third work station positioned within the periphery of the locus of travel of the free end of said robot arm for automatically performing the tasks of, immersing said first and second terminals in flux, immersing said first and second terminals in solder, and electrically testing the coils after immersion of said terminals in solder;

whereby said robotic arm transfers bobbins from said first work station to said second work station, bobbins from said second work station to said third work station and bobbins from said third work station to an area for disposal.

6. The apparatus as claimed in claim 5, further comprising a central controller for controlling the operations of said first, second, and third work stations, and said robotic arm.

* * * * *